US008523627B2

(12) United States Patent
Tseng

(10) Patent No.: US 8,523,627 B2
(45) Date of Patent: Sep. 3, 2013

(54) MODEL HELICOPTER WITH IMPROVED REDUCTION GEAR MECHANISM

(76) Inventor: Shu-Mei Tseng, Taipei (TW)

( * ) Notice: Subject to any disclaimer, the term of this patent is extended or adjusted under 35 U.S.C. 154(b) by 558 days.

(21) Appl. No.: 12/779,962

(22) Filed: May 14, 2010

(65) Prior Publication Data

US 2011/0277575 A1 Nov. 17, 2011

(51) Int. Cl.
*A63H 27/00* (2006.01)

(52) U.S. Cl.
USPC ..... 446/37; 244/60; 244/17.23; 416/170 R; 415/122.1; 74/410; 446/57; 446/34

(58) Field of Classification Search
USPC ..... 446/34, 37, 38, 57, 58; 416/170 R; 475/149, 331; 415/122.1; 244/60, 17.11, 244/17.19, 17.23, 17.25; 74/665 K, 665 B, 74/665 E, 412 R, 413
See application file for complete search history.

(56) References Cited

U.S. PATENT DOCUMENTS

| | | | | |
|---|---|---|---|---|
| 2,823,558 | A * | 2/1958 | Semar et al. | 74/665 B |
| 2,968,965 | A * | 1/1961 | Swanson et al. | 74/409 |
| 3,188,884 | A * | 6/1965 | Bancroft | 74/665 K |
| 3,244,024 | A * | 4/1966 | Flowers | 74/665 K |
| 3,402,622 | A * | 9/1968 | Matut Archanco | 475/338 |
| 6,122,985 | A * | 9/2000 | Altamura | 74/410 |
| 6,227,481 | B1 * | 5/2001 | Fenny et al. | 244/7 R |
| 6,264,138 | B1 * | 7/2001 | Hawkins | 244/60 |
| 6,364,611 | B1 * | 4/2002 | Matsuda et al. | 416/170 R |
| 6,761,082 | B2 * | 7/2004 | Hulshof | 74/410 |
| 6,769,874 | B2 * | 8/2004 | Arel | 416/95 |
| 6,902,508 | B2 * | 6/2005 | Stille et al. | 475/331 |
| 7,069,802 | B2 * | 7/2006 | Mikhail et al. | 74/410 |
| 2006/0046609 | A1 * | 3/2006 | Laurienzo et al. | 446/435 |
| 2012/0231924 | A1 * | 9/2012 | Monteiro De Lima | 475/344 |

* cited by examiner

*Primary Examiner* — Gene Kim
*Assistant Examiner* — Urszula M Cegielnik

(57) ABSTRACT

A model helicopter includes a drive mechanism comprising a battery powered motor comprising a toothed motor shaft; a main rotor comprising a main shaft aligned with the motor shaft and including a main gear; and a reduction gear assembly comprising a lower section including four first gears arranged around the motor shaft, and four second gears smaller than the first gears, each second gear fixed to top of the first gear; an upper section including four third gears and four fourth gears each being smaller than the third gear and fixed to top of the third gear, the fourth gears being meshed with the main gear; and four shafts each axially passing through the fourth gear, the third gear, the second gear, and the first gear so that a revolution of the motor shaft rotates the main shaft via the first gears, the fourth gears, and the main gear.

3 Claims, 4 Drawing Sheets

MODEL HELICOPTER WITH IMPROVED REDUCTION GEAR MECHANISM

BACKGROUND OF THE INVENTION

1. Field of Invention

The invention relates to radio-controlled helicopters and more particularly to a model helicopter having a motor with a motor shaft being coaxial with a main shaft of a main rotor and an improved reduction gear mechanism.

2. Description of Related Art

Major components of a drive mechanism of a typical type of model helicopter are shown in FIGS. 1 and 2 and comprise a motor (e.g., battery powered servo motor) 10, a small gear 12 fixed to a motor shaft of the motor 10, a main gear 11 in mesh with the small gear 12, a main shaft 1 fixed to the main gear 11, and a main rotor 13 at a top of the main shaft 1 and co-rotated therewith.

It is understood that the more powerful of the motor 10 the larger of the main gear 11 will be (i.e., greater diameter). One type of model helicopter having a main gear 11 with a diameter of 120 mm is available. However, greater diameter of main gear is not desired since it can adversely affect maneuverability, shorten the useful life of components, and greatly consume energy.

The invention is intended to obviate the above drawbacks by providing a model helicopter having a motor with a motor shaft being coaxial with a main shaft of a main rotor.

SUMMARY OF THE INVENTION

It is therefore one object of the invention to provide a model helicopter comprising a drive mechanism, the drive mechanism comprising a battery powered motor comprising a toothed motor shaft; a main rotor comprising a main shaft aligned with the motor shaft, the main shaft including a main gear; and a reduction gear assembly comprising a lower section including four first gears arranged around the motor shaft, and four second gears smaller than the first gears, each second gear fixed to top of the first gear; an upper section including four third gears and four fourth gears each being smaller than the third gear and fixed to top of the third gear, the fourth gears being meshed with the main gear; and four shafts each axially passing through the fourth gear, the third gear, the second gear, and the first gear so that a revolution of the motor shaft rotates the main shaft via the first gears, the fourth gears, and the main gear.

The above and other objects, features and advantages of the invention will become apparent from the following detailed description taken with the accompanying drawings.

DETAILED DESCRIPTION OF THE INVENTION

Figure 1:
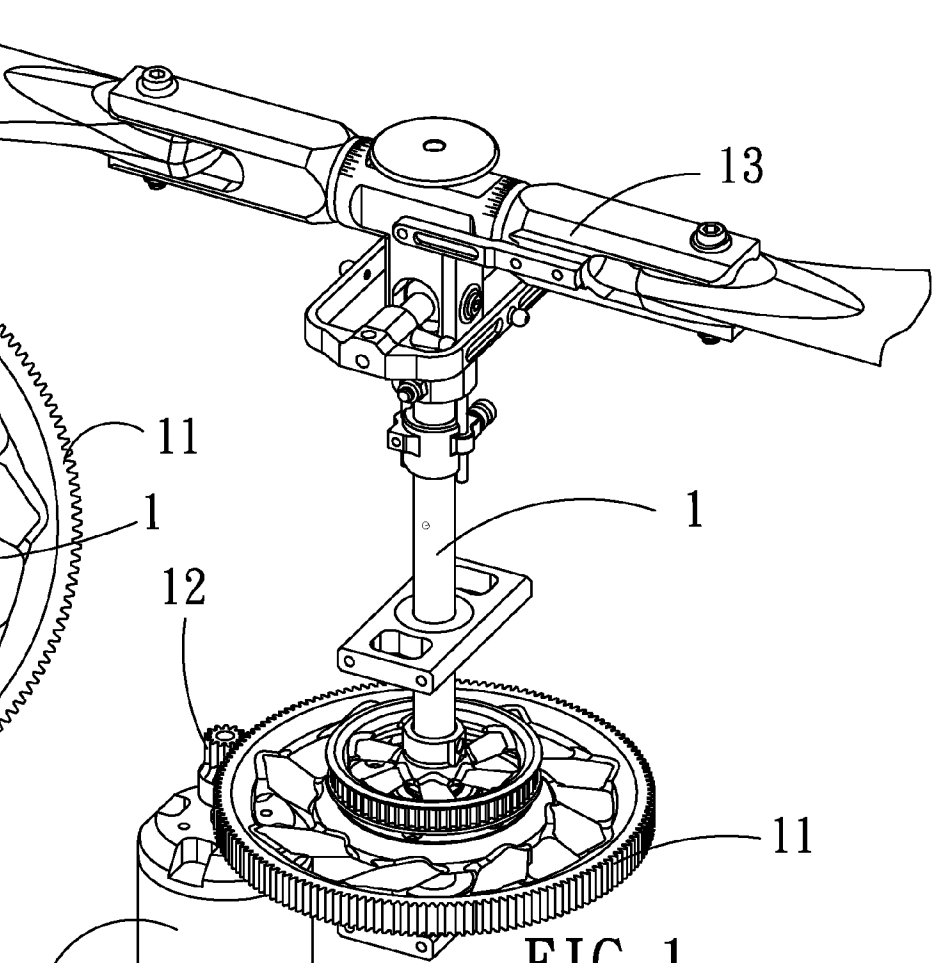
FIG. 1 (PRIOR ART)
FIG. 1 is a perspective view of major components of a drive mechanism of a typical model helicopter.
Figure 2:
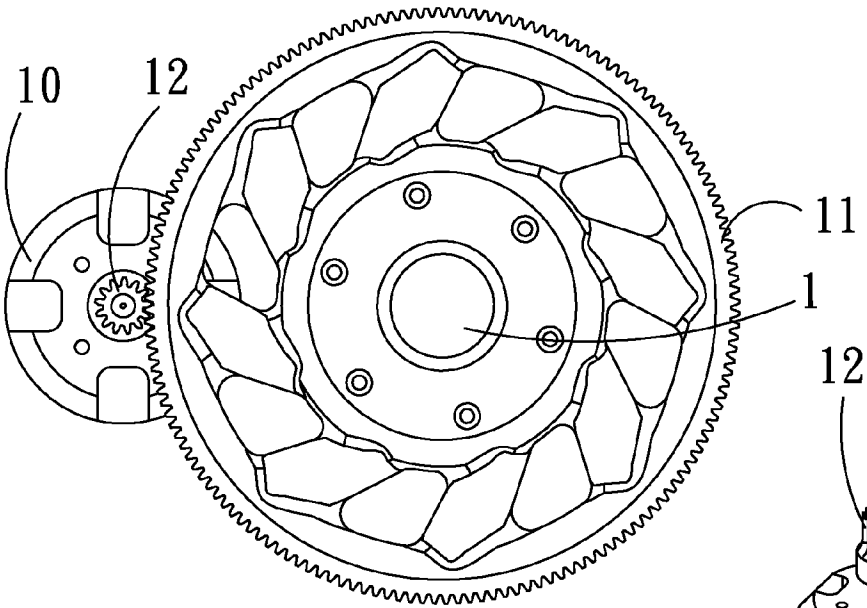
FIG. 2 (PRIOR ART)
FIG. 2 is a top plan view of FIG. 1 with the main rotor removed for clarity.
Figure 3:
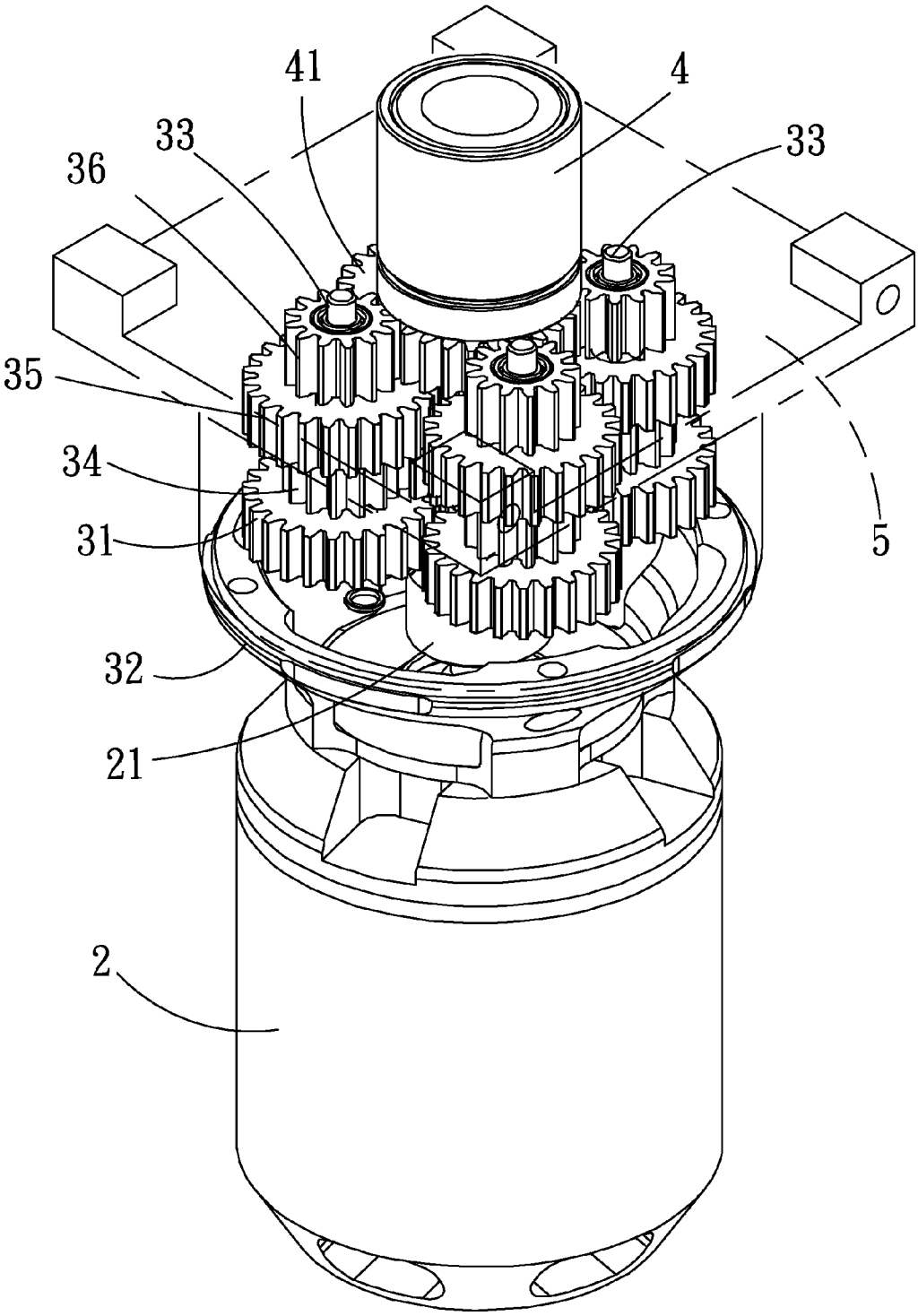
FIG. 3 is a perspective view of major components of a drive mechanism of a model helicopter according to the invention with a main rotor and a substantial portion of a main shaft removed.
Figure 4:
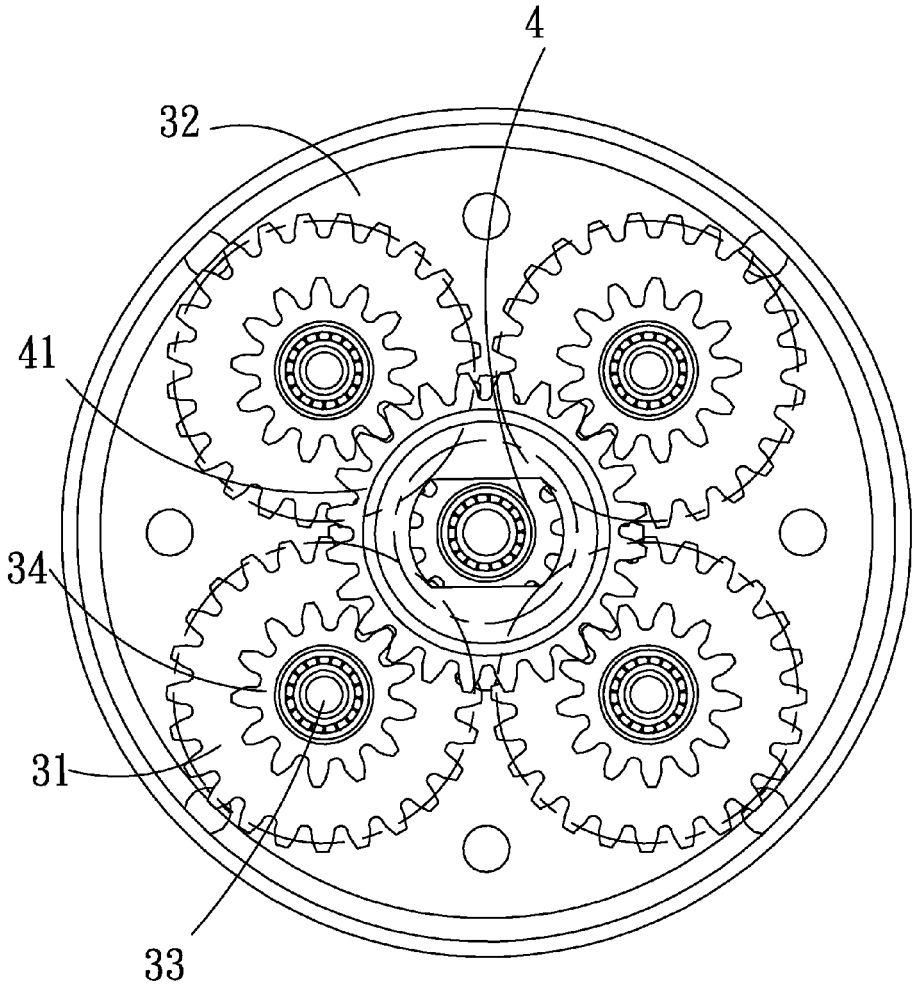
FIG. 4 is a top plan view of a lower section of the reduction gear assembly of FIG. 3.
Figure 5:
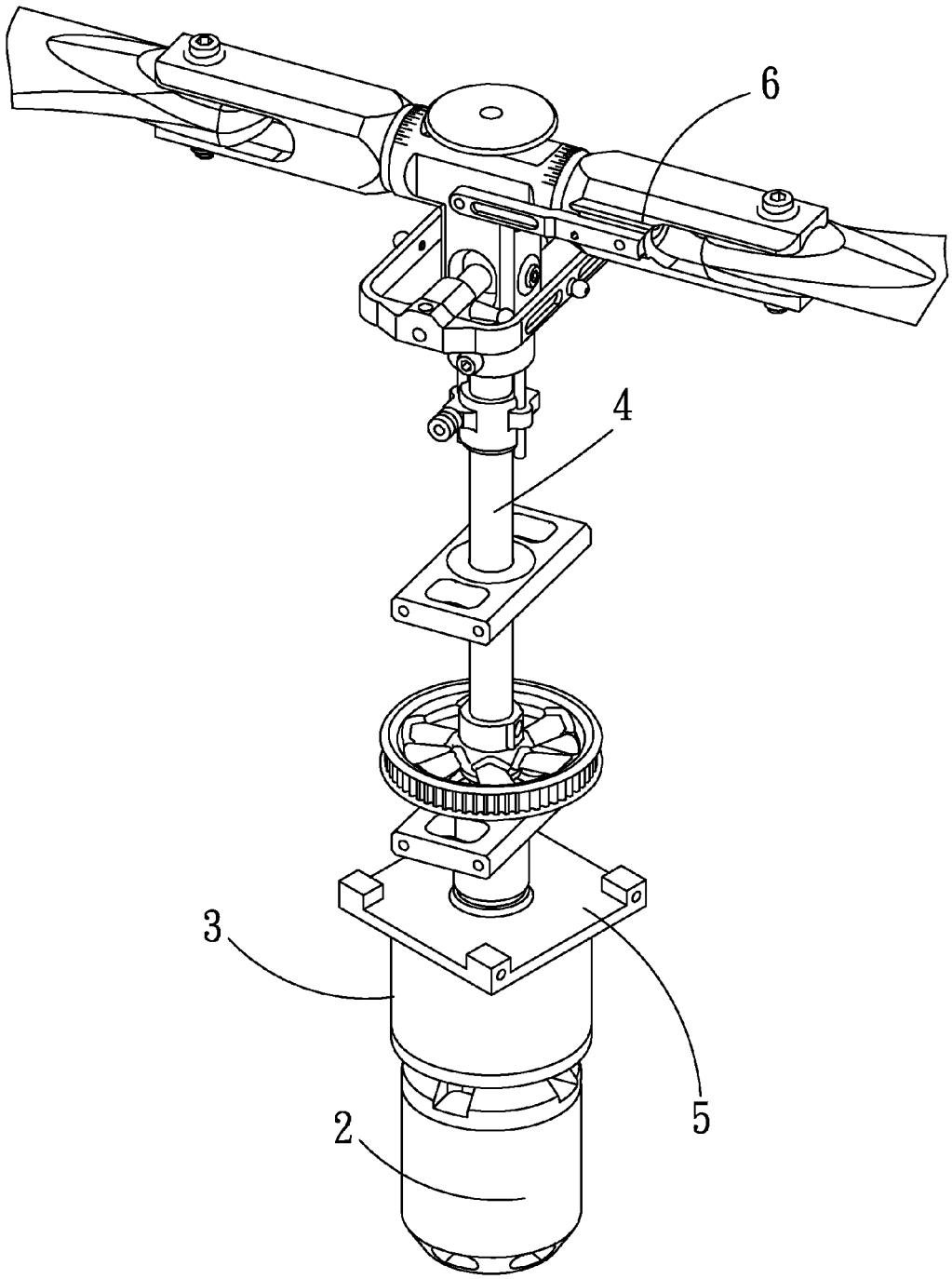
FIG. 5 is a perspective view of the major components of the drive mechanism of the model helicopter according to the invention.

Referring to FIGS. 3 to 5, a drive mechanism of a model helicopter according to the invention is shown. A tail rotor and its associated components are not the subject of the invention and are not shown and described for brevity.

Major components of the drive mechanism comprise a motor (e.g., battery powered servo motor) 2, and a reduction gear assembly 3. A toothed motor shaft (only a portion being shown in FIG. 3) 21 of the motor 2 has a portion disposed in the reduction gear assembly 3. The reduction gear assembly 3 includes a circular base 32; a lower section mounted on the base 32 and having four large gears 31 arranged as four corners of a virtual square, and four small gears 34 each fixed to top of the large gear 31; an upper section having four large gears 35 arranged as four corners of a virtual square, and four small gears 36 each fixed to top of the large gear 35; and four shafts 33 each passing through the upper small gear 36, the upper large gear 35, the lower small gear 34, and the lower large gear 31 at the same corners of the squares and fixed thereto. The large gears 31 of the lower section are meshed with the toothed motor shaft 21 of the motor 2. The reduction gear assembly 3 is enclosed by a reduction gear box (not numbered).

It is noted that the number of each of the gears 31, 34, 35, 36 and shafts 33 can be different from four in other embodiments (e.g., three).

Major components of the drive mechanism comprise further comprise a main shaft 4, a main gear 41 fixed to the main shaft 4 and meshed with the four upper small gears 36, a plate member 5 disposed on top of the reduction gear assembly 3, and a main rotor 6 fixed to top end of the main shaft 4 and co-rotated therewith.

The revolution of the toothed motor shaft 21 of the motor 2 will rotate the main shaft 4 via the lower large gears 31, the upper small gears 36, and the main gear 41. Eventually, the main rotor 6 rotates at the number of revolution determined by the gear reduction ratio of the toothed motor shaft 21 to the large gear 31 and that of the small gear 36 to the main gear 41.

It is envisaged by the invention that maneuverability and stability can be improved, the useful life of components can be prolonged, and energy consumption can be reduced because the motor shaft of the motor is aligned with the main shaft of the main rotor and the provision of the reduction gear assembly.

While the invention herein disclosed has been described by means of specific embodiments, numerous modifications and variations could be made thereto by those skilled in the art without departing from the scope and spirit of the invention set forth in the claims.

What is claimed is:

1. A drive mechanism for a model helicopter, comprising:

a battery powered motor comprising a toothed motor shaft;

a main rotor, having a main shaft aligned with the motor shaft; and a reduction gear assembly comprising:

a base, being passed through by the toothed motor shaft;

three first gears, arranged around and meshed with the toothed motor shaft and on the base;

three second gears, being smaller than the first gears in diameter and separately coaxially fixed on the first gears;

three third gears, separately coaxially fixed on the second gears; and three fourth gears, being smaller than the third gears in diameter and separately coaxially fixed on the third gears;

wherein the fourth gears are meshed with a main gear, and four shafts, which are axially parallel to the toothed motor shaft, separately axially pass through the fourth gears, the third gears, the second gears, and the first gears.

2. The drive mechanism of claim 1, wherein the four shafts are rotatably fixed on the base.

3. The drive mechanism of claim 1, wherein the third gears are greater than the second gears in diameter.

* * * * *